United States Patent [19]

Hecht

[11] 3,930,848

[45] Jan. 6, 1976

[54] HIGH TEMPERATURE LOW DENSITY COBALT ALLOY

[75] Inventor: Ralph J. Hecht, West Palm Beach, Fla.

[73] Assignee: United Technologies Corporation, Hartford, Conn.

[22] Filed: Jan. 20, 1975

[21] Appl. No.: 542,463

[52] U.S. Cl. ..... 75/171

[51] Int. Cl.[2] ..... C22C 19/07

[58] Field of Search ..... 75/171, 170; 148/32, 32.5

[56] References Cited

UNITED STATES PATENTS 3,667,939 6/1972 Hecht et al. ..... 75/171

*Primary Examiner*—R. Dean

*Attorney, Agent, or Firm*—Charles E. Sohl

[57] ABSTRACT

A cobalt base superalloy is disclosed which has good elevated temperature properties combined with low density and low cost. The alloy has a nominal composition of .9% carbon, 25% chromium, 15% nickel, 7.5% tungsten, 2.2% titanium, 1.2% zirconium, 1.0% iron, balance essentially cobalt, and is substantially free from columbium and tantalum.

2 Claims, 1 Drawing Figure

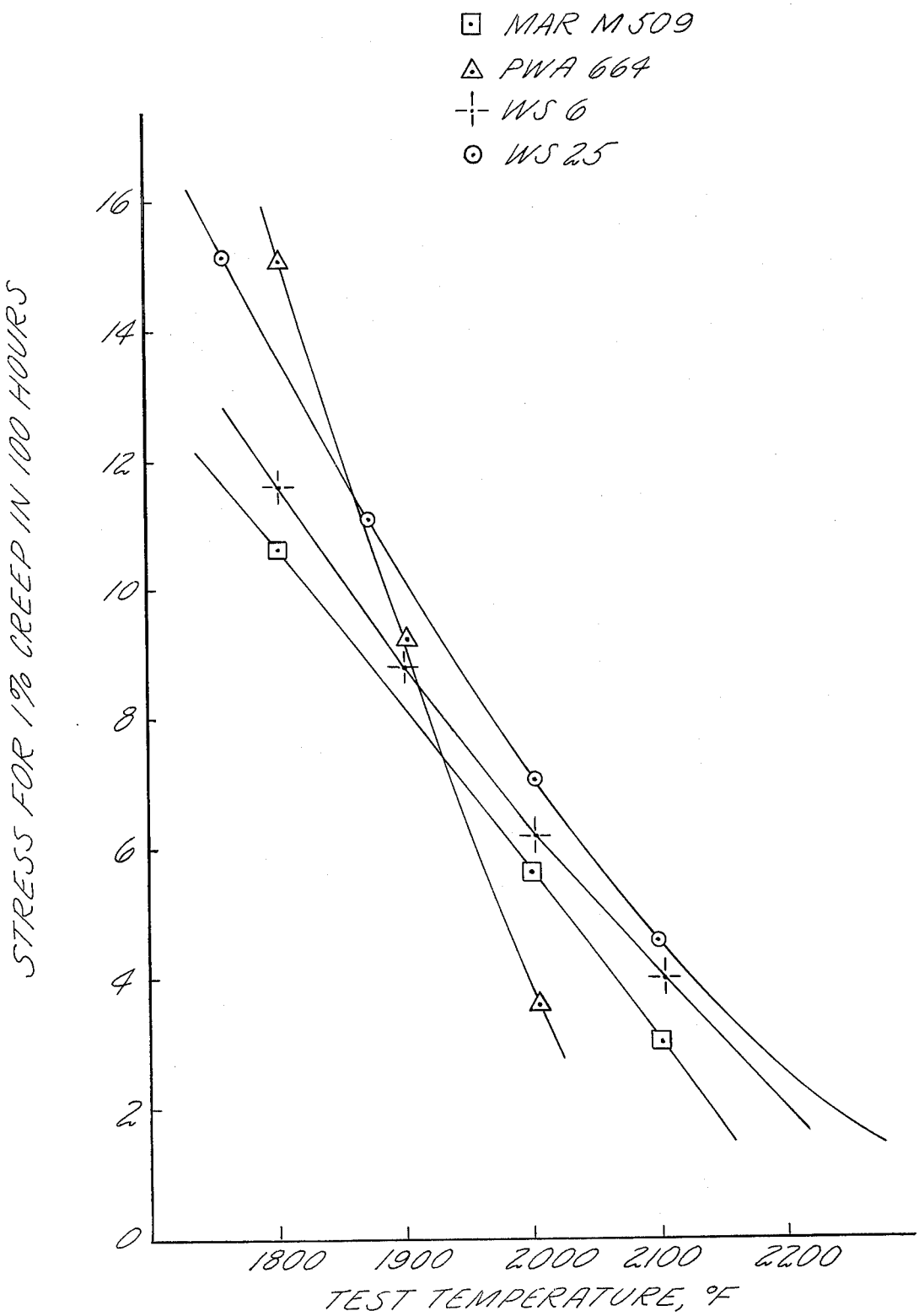
MAR M509
PWA 664
WS 6
WS 25
STRESS FOR 1% CREEP IN 100 HOURS
0
2
4
6
8
10
12
14
16
1800
1900
2000
2100
2200
TEST TEMPERATURE, °F

HIGH TEMPERATURE LOW DENSITY COBALT ALLOY

The invention herein was made in connection with a contract with the Department of the Air Force.

BACKGROUND OF THE INVENTION

The present invention relates to the field of cobalt base superalloys.

Service conditions in gas turbine engines are constantly increasing in severity and improved turbine materials are required for satisfactory operation. Cobalt base alloys are often used in turbine engines particularly in areas where high operating temperatures are encountered. Conventional base cobalt alloys almost invariably contain tantalum and columbium which to date, have been believed to provide improved elevated temperature properties.

U.S. Pat. No. 3,432,294 discloses an alloy having a composition similar to the alloy of the invention except that the alloy of the reference contains from 2–5% tantalum and contains lower levels of titanium and zirconium than the present alloy. There is no suggestion in this reference that the elimination of tantalum would have any beneficial effects. Canadian Pat. No. 639,056 also discloses an alloy similar to the present invention but the alloy of this reference contains from 1–4% tantalum or columbium. Additionally, other elements of the alloy of this reference are present in different amounts than the alloy of the present invention. Likewise, U.S. Pat. No. 3,677,939, assigned to the assignee of the present invention, has a composition similar to the composition of the present invention except for the presence of columbium and tantalum.

The present invention discloses an alloy substantially free from both columbium and tantalum which also has superior mechanical properties to alloys which contain columbian and tantalum.

This body of art and, in fact, the experience of those skilled in the art, clearly demonstrates that the cobalt superalloy is one in which small but critical limitations are often determinative as to whether or not a given alloy is usable for the purpose intended. Nor is the art one of reasonable empirical certainty as the results of small changes in either the character or proportions of an alloy are not normally truly predictable.

SUMMARY OF THE INVENTION

The present invention discloses a cobalt base super alloy having a nominal composition of 9% carbon, 25% chromium, 15% nickel, 7.5% tungsten, 2.2% titanium, 1.2% zirconium, 1% iron, balance essentially cobalt.

The alloy of the invention possesses an exceptional combination of mechanical properties at elevated temperatures, low density and low cost.

BRIEF DESCRIPTION OF THE DRAWING

The FIGURE shows a plot of the stress required to produce 1% creep in 100 hours for various temperatures for the alloy of the invention and several competitive alloys.

DESCRIPTION OF THE PREFERRED EMBODIMENT

The present invention relates to a cobalt base super alloy with an advantageous combination of properties and cost. The composition of the alloy is given below in Table I. A noteworthy feature of the present alloy composition is the substantial lack of columbian and tantalum which are commonly found in prior art alloys.

The physical metallurgy of cobalt base superalloys for use in turbine blades and vanes is based around a cobalt chromium-carbon base composition. The chromium addition serves to provide improved oxidation and corrosion resistance while the carbon forms carbides which have a strengthening effect. Refractory metal carbides are formed by the reaction of additions of columbium, titanium, zirconium, hafnium and tungsten with carbon in the alloy. These refractory elements also provide solid solution strengthening. Additions of nickel and iron are made to stabilize the face center cubic cobalt structure and prevent it from transforming to a hexagonal close packed structure. Further, nickel and iron promote improved ductility in the alloy.

Cobalt base superalloys must satisfy increasingly stringent requirements as the severity of operating conditions in turbine engines increases. Satisfactory compositions must possess good elevated mechanical properties such as strength, ductility, toughness, creep and rupture resistance and must further possess oxidation resistance.

Weight is an important consideration in many aerospace and transportation applications. Weight is especially important in military applications where the ultimate in performance is required. Contrary to the suggestions of the prior art, it was found, as an unexpected result, during the work which lead to the present invention, that under certain conditions, that tantalum and columbium could be effectively eliminated from certain types of cobalt base alloys and that in fact such substantial elimination could lead to improved mechanical properties and other benefits. FIG. 1 shows a plot comparing the creep characteristics (stress required to produce 1% creep in 100 hrs. at temperature) of the alloy of the present invention with certain other commercial alloys, the compositions of the commercial alloys are given in Table II. The alloy described as WS 25 is the alloy of the preferred embodiment. The alloy denoted as WS 6 is a similar cobalt base alloy containing columbium and tantalum which is described in U.S. Pat. No. 3,667,939 and assigned to the present assignee. PWA 664 is a nickel base superalloy which is frequently used in gas turbines. MAR M509 is a tantalum containing cobalt base superalloy. It is evident from consideration of this FIGURE that the alloy of the present invention possess superior creep properties at temperatures above 1900°F. and that of the four alloys tested the alloy of the present invention possesses the best combination of mechanical properties for use at elevated temperatures.

TABLE I

| WS 25 Composition | |
|---|---|
| Co | Bal. |
| C | .85–.95 |
| Cr | 24–26 |
| Ni | 14–16 |
| W | 7.25–7.75 |
| Ta, Cb | Ta + Cb < .5 (impurity type limit) |
| Ti | 2.0–2.4 |
| Zr | 1.0–1.4 |
| Fe | .9–1.1 |

TABLE II

| | Comparative Alloy Composition (alloy shown in FIG. 1) | | | |
|---|---|---|---|---|
| | WS 25 | WS 6 | PWA 664 | MAR M509 |
| Co | Bal. | Bal. | 10.0 | Bal |
| C | .9 | .83–.97 | .13 | .6 |
| Cr | 25 | 24–26 | 9.0 | 24 |
| Ni | 15 | 14–16 | Bal. | 10 |
| W | 7.5 | 7.5–8 | 12.5 | 7 |
| Ta | <.5 | 2.5–3.0 | — | 7.5 |
| Cb | | .8–1.2 | 1.0 | — |
| Ti | 2.2 | .8–1.0 | 2.0 | .2 |
| Zr | 1.2 | .35–.45 | — | — |
| Fe | 1.0 | .8–1.2 | — | 1.0 |

An alloy similar to the alloy of the preferred embodiments, but containing 1.5% tantalum, 0.5% columbium, and reduced titanium and zirconium levels of 1.0% and 0.5% respectively was compared with the preferred alloy. At a temperature of 1800°F. and a stress level of 12,000 psi the preferred alloy had a life of 1316.7 hrs. while the alloy with tantalum and columbium failed after 367 hours. At a temperature of 2200°F. and a stress level of 3,000 psi, the rupture times of the preferred alloy and the tantalum and columbium containing alloy were 177.9 and 69.1 hours respectively.

Two further significant benefits arise from the elimination of tantalum and columbium. The first benefit relates to density. Columbium and tantalum have density of 0.31 and 0.6 pounds per cubic inch respectively. In the alloy of the present invention, tantalum and columbium are replaced by titanium and zirconium which have density of 0.163 and 0.235 pounds per cubic inch respectively. The resultant alloy has a density of 0.305 pounds per cubic inch which is remarkably low for a cobalt base superalloy.

The other significant advantage which derives from the replacement of columbium and tantalum by titanium and zirconium relates to cost. Columbium and tantalum are expensive, costing approximately 25 and 50 dollars per pound respectively. Titanium and zirconium on the other hand are comparatively inexpensive costing approximately $1.75 and $12.00 per pound respectively. The economic consequence of the elimination of tantalum and columbium are that the resultant alloy is from $2.00 – $3.00 a pound less expensive than competitive alloys which contain columbium and tantalum.

What is claimed is:

1. A cobalt base alloy for high temperature use which consists essentially of, by weight, from 0.85 to 0.95% carbon, from 24 to 26% chromium, from 14, to 16% nickel, from 7.25 to 7.75% tungsten, from 2.0 to 2.4% titanium, from 1.0 to 1.4% zirconium, from 0.9 to 1.1% iron, balance essentially cobalt, said alloy being substantially free from tantalum and columbium.

2. An alloy as in claim 1 wherein the total tantalum plus colubium level is limited to be less than 0.5%.

* * * * *